United States Patent [19]

Geweniger

[11] Patent Number: 4,559,793

[45] Date of Patent: Dec. 24, 1985

[54] PROCESSING PLANT FOR TREATING HIDES, SKINS, PIECES OF LEATHER AND THE LIKE

[76] Inventor: Karl-Otto Geweniger, Åkerövägen 11, S-262 00 Ängelholm, Sweden

[21] Appl. No.: 433,487

[22] Filed: Oct. 8, 1982

[30] Foreign Application Priority Data

Oct. 12, 1981 [SE] Sweden ..... 8106008

[51] Int. Cl.[4] ..... C14B 1/02

[52] U.S. Cl. ..... 69/33; 69/32

[58] Field of Search ..... 69/21, 29, 32, 33, 34, 69/35

[56] References Cited

U.S. PATENT DOCUMENTS

| | | | |
|---|---|---|---|
| 1,077,207 | 10/1913 | Wayland | 69/29 X |
| 1,090,799 | 3/1914 | Spigno | 69/33 X |
| 1,352,244 | 9/1920 | Blatz | 69/21 X |
| 1,370,392 | 3/1921 | Wright et al. | 69/33 X |
| 3,762,190 | 10/1973 | Ruffer et al. | 69/32 |
| 4,100,771 | 7/1978 | Dokoupil | 69/21 X |

FOREIGN PATENT DOCUMENTS

| | | | |
|---|---|---|---|
| 1914910 | 10/1970 | Fed. Rep. of Germany | 69/33 |
| 1914964 | 10/1970 | Fed. Rep. of Germany | 69/33 |
| 1914965 | 10/1970 | Fed. Rep. of Germany | 69/33 |
| 2330767 | 7/1977 | France | 69/32 |
| 7001513 | 8/1970 | Netherlands | 69/33 |
| 297674 | 12/1971 | U.S.S.R. | 69/33 |

*Primary Examiner*—Wm. Carter Reynolds

*Attorney, Agent, or Firm*—Beveridge, DeGrandi & Weilacher

[57] ABSTRACT

The invention relates to a process of treating workpieces consisting of hides, skins, pieces of leather or the like and is characterized by subjecting the workpiece in conjunction with a drying operation to lateral and longitudinal stretching by way of a stretching operation which comprises extension of an elastic conveyor belt on which the workpiece is conveyed. The invention also relates to machine units which can be assembled to form complete treating plants and each of which is equipped with an elastic conveyor belt for conveyance of the workpiece and with apparatus for providing, by extension and bending of the conveyor belt, a stretching and softening treatment of the workpiece, and preferably also with apparatus for drying or remoistening the workpiece.

1 Claim, 5 Drawing Figures

PROCESSING PLANT FOR TREATING HIDES, SKINS, PIECES OF LEATHER AND THE LIKE

This invention relates to a process of drying, stretching, softening and remoistening strip-shaped pieces of material, particularly hides, skins, pieces of leather or the like, and the invention also relates to an apparatus for carrying the process into effect.

It is known that treatments of various kinds, which comprise drying and/or moistening, can result in shrinking, crinkling or shrivelling and necessitate distension of the material to restore its original dimensions and restore or improve the shape and surface nature of the material.

Typical examples of such treatments are softening and conditioning treatments of workpieces consisting of hides, skins and furs with a view to making the workpieces suitable for a subsequent treatment, for manufacture or for storage. However, there are no suitable machine systems available, with which all of these treatments can be carried out in continuous sequence and with insignificant expenditure of human work.

With the procedures used heretofore it is customary that workpieces of hides, skins, furs and the like are dried in suitable machine systems without any simultaneous shrinkage-preventing treatment, and the consequence is a shrinkage which may amount to 10–12%; it is then difficult or impossible to achieve a 100% restoration of the original size of the workpiece by subsequent distending and stretching processes. Another disadvantage is that the stretching processes hitherto used make it necessary for personnel to partly manually stretch the workpiece in a steel frame, which owing to the nature of the material may involve serious ergonomic and medical problems. Besides, the wage costs for the current handling operations are high and seriously reduce profitability.

The object of the invention is to provide a process which to a high extent substitutes machine operations for manual operations and makes a treatment possible without any shrinkage or with considerably lower residual shrinkage.

These objects have now been attained by the process described herein process according to the invention has been given the characteristic features defined by claim 1.

The invention also comprises a machine unit for carrying the process into effect.

The invention will now be more fully described below with reference to the accompanying diagrammatic drawings in which.

Figure 1:
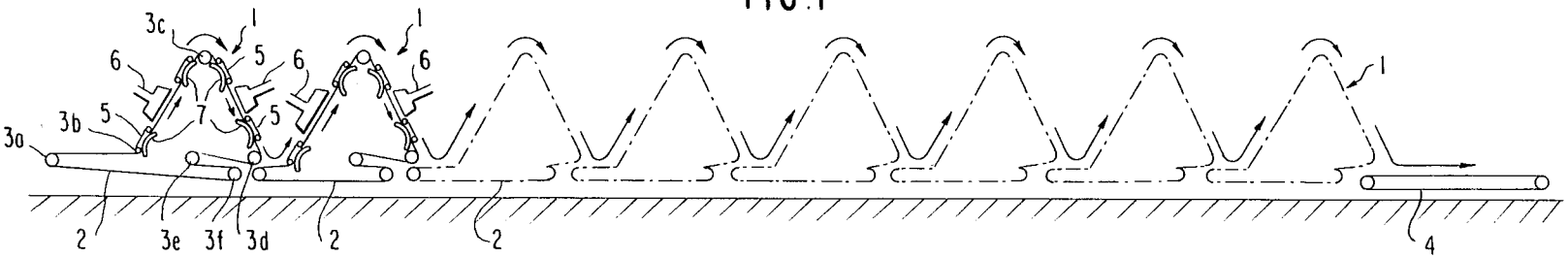
FIG. 1 is a side elevation of a plant composed of fundamentally similar machine units for carrying out the process according to the invention.

The plant illustrated in FIG. 1 comprises for instance eight machine units of fundamentally the same basic construction as the first machine unit 1 which is described in more detail below.

The machine unit 1 comprises a conveyor with an endless conveyor belt 2 of elastic material, such as elastic textile rubber, which runs over a series of rolls or rollers at least some of which are driven while the others are idling. The conveyor belt 2 runs at the supply end of the plant along a preferably horizontal path between two return pulleys 3*a*, 3*b* and from the rear one 3*b* of said pulleys over other return pulleys, such as 3*c*–3*f*. One of the rollers of one of belts 5 may form the rear one 3*b* of the returned pulleys 3*a*, 3*b* mentioned above and as shown in FIG. 1 for the first two units 1. To reduce the length of the plant horizontally the conveyor belt runs between the return pulleys 3*b* and 3*d* in a triangular path upwardly and rearwardly to and over the return pulley 3*c* and from said pulley downwardly and rearwardly to the return pulley 3*d*, from where the belt extends forwardly, i.e. towards the supply end, over the return pulley 3*e* and from said return pulley rearwardly over the return pulley 3*f* and forwardly to the return pulley 3*a* at the supply end. The return pulley 3*e* also constitutes a movable stretching roller for the conveyor belt.

The conveyor belt of the next following machine unit forms with its front horizontal part a receiving station for receiving material from the conveyor belt of the preceding unit at the rear return pulley 3*d* thereof, and the last-mentioned return pulleys are therefore placed at and preferably slightly above the front end of the conveyor belt of the next following unit.

The material, i.e. workpieces of leather, hides, skins or the like, are thus conveyed in an undulating and continuous (for instance as in FIG. 1 sinusoidal) path from the inlet end of the plant to the outlet end thereof, where a discharge conveyor 4 receives and discharges the ma- terial.

In conjunction with each conveyor belt a number of endless, elastic stretching and softening belts 5 for stretching the material longitudinally and for softening the material in cooperation with other means to be described in the following are spaced suitable distances apart. The elastic stretching and softening belts 5 and rollers for them may be arranged in the same manner as short single belt conveyors. These short "conveyors" have no real conveying function but are preferably driven. Means 6 for drying, for instance for blowing hot air against the material on the conveyor 2, are provided between adjacent return pulleys for adjacent stretching and softening belts 5. Two such hot air blowing means 6 are shown for the machine unit 1. However, several hot air blowing means can be used for each unit, or the units or groups of units may be placed in drying cabinets or drying hoods; alternatively, the entire plant may be housed in a closed dome or tunnel where drying and remoistening can be performed. For in the rear portion of the plant the drying means, such as the hot air blowing means 6, may be replaced by moistening means which may be of the same structural design as the blowing means 6 but are adapted, instead of blowing hot air, to blow steam or a moistening spray onto the material.

The plant may also comprise means for determining the moisture content of the material, and these means may be adapted to control the drying and remoistening operations.

Figure 4:
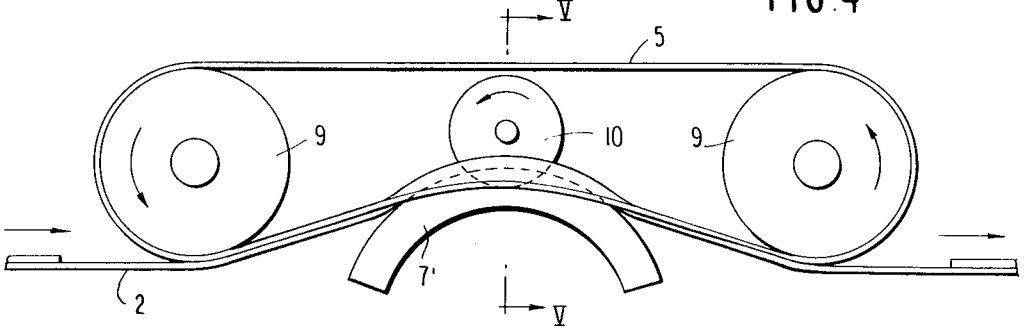
FIG. 4 is a view similar to FIG. 2, but showing a stretching and softening device of modified design.
Figure 5:
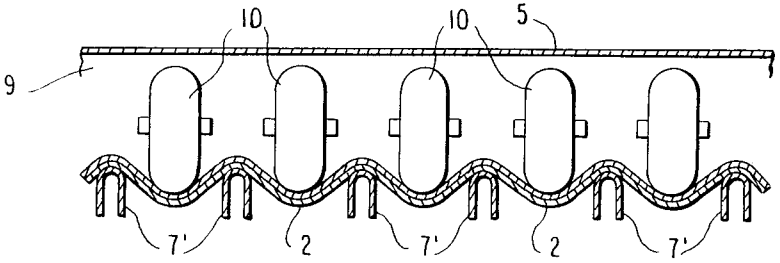
FIG. 5 is a cross-section taken on the line V—V in FIG. 4.
Figure 2:
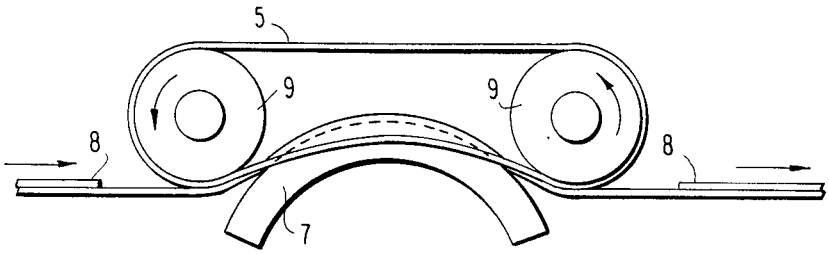
FIG. 2 is a side elevation, on a larger scale, of part of a machine unit in FIG. 1 with a device for stretching and softening treatment of workpieces during their conveyance on a belt conveyor.
Figure 3:
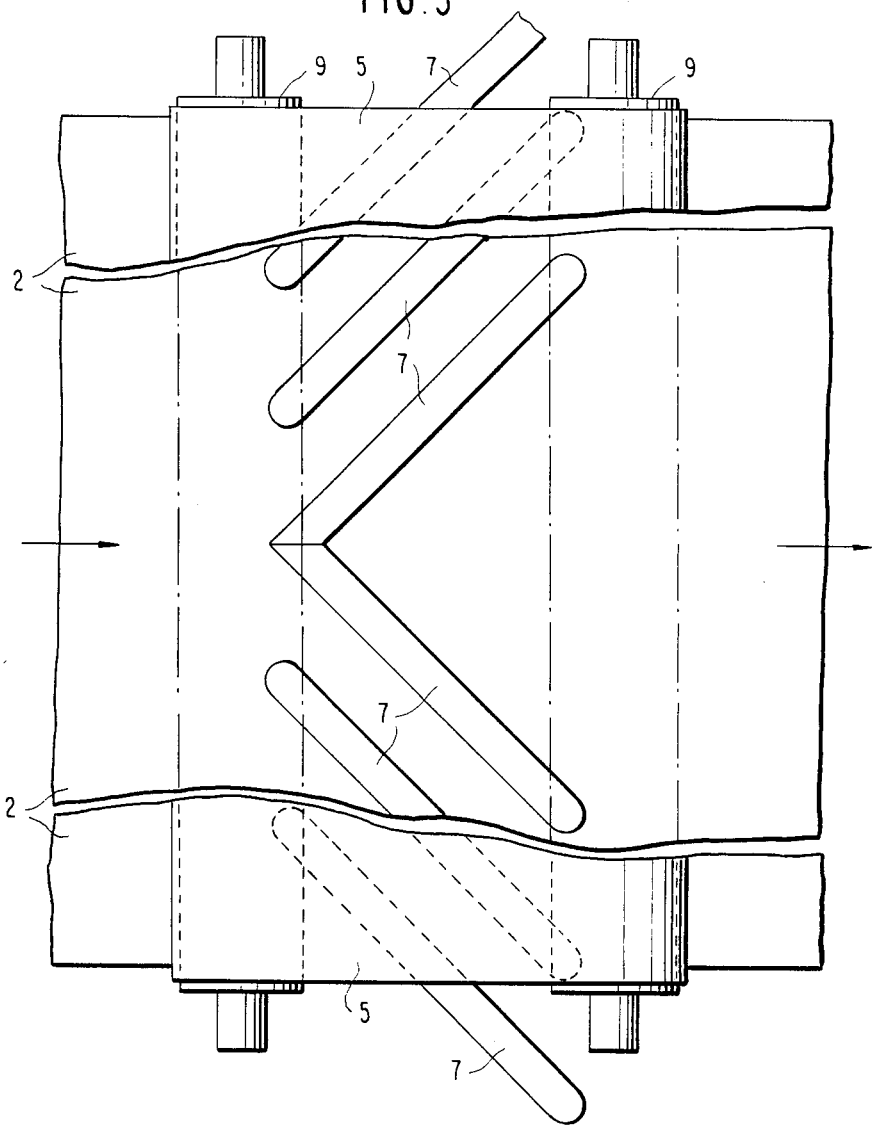
FIG. 3 is a plan view of the part shown in FIG. 2.

The stretching and softening belt 5 and the means cooperating therewith may be of the embodiment shown in FIGS. 2 and 3, or the embodiment shown in FIGS. 4 and 5. Alternatively, the two embodiments can also be used in one and the same machine unit or for different machine units 1.

In the embodiment illustrated in FIGS. 2 and 3, a series of stretching cams 7 are arranged at the rear face of the conveyor belt 2 opposite each stretching and softening belt 5. Said stretching cams may be in the form of curved rails which have smooth surfaces and are carried by the machine frame (not shown). The conveyor belt 2 of the conveyor is urged against the backs or crests of the circularly or arcuately curved rails 7 by the stretching and softening belts in that the latter (see FIG. 2) are applied by their return pulleys 9 against the conveyor belt 2 so that the two belts 2, 5 are curved by the back or crest portions of the rails 7. The rails 7 are inclined in opposite directions from the centre line of the conveyor belt 2 and tend by cam action to expand the elastic belts 2, 5 laterally in opposite directions from the central portion of workpieces and also longitudinally, whereby each workpiece between the belts is stretched in all directions where it passes over the rails 7. It should be observed that the rails 7 are so arranged that the conveyor belt 2 is urged locally upwardly in the region of each rail and that the stretching and softening belt 5 assumes the same shape, whereby the workpieces 8 are subjected to the desirable stretching laterally and longitudinally and to a softening kneading action against the backs or crests formed by the rails 7 via the conveyor belt 2.

Instead of the stationary rails 7 use could also be made of rotary disks or cam rolls which might be driven, idling, counter-rotating and optionally braked, it being possible optionally to control the braking action down to standstill.

The stretching and softening means may alternatively be of the design shown in FIGS. 4 and 5, in which the stretching and softening belt 5 cooperates with cams in the form of rails 7' which may be parallel or inclined in opposite directions from the central portion of the conveyor belt 2, and with holding-down wheels 10 for holding down the belts and the material between the cams 7'.

The wheels 10 are mounted for rotation in the machine frame and located between the facing runs of the stretching and softening belt 5 opposite the interstices between the rails 7'. The wheels 10 may optionally be driven but may also be mounted only for rotation and optionally braked so as to run more slowly than do the belts. The wheels 10 have a preferably circularly curved outer profile in the transverse direction (see FIG. 5) and a smooth surface. The stretching and softening belts 5 are preferably driven such that a trailing belt tends to run more rapidly than a leading belt to stretch the material in the longitudinal direction in the region between adjoining belts. The wheels 10 in FIGS. 4 and 5 effect not only a stretching in the transverse direction but also a not insignificant stretching in the longitudinal direction, and as the material is simultaneously stretched in the longitudinal direction between two adjoining stretching and softening belts 5 the total stretching will become more effective at the same time as a lenient but very effective softening kneading action against the wheels and the cams is attained. The conveyor belts in the successive machine units are preferably driven with successively, i.e. from unit to unit, increasing speed to compensate for the elongation of the material brought about by the stretching. For example, plant personnel can control the speed of successive units by manual adjustment. Said elongation is preferably so dimensioned that the shrinkage resulting from the drying will be entirely eliminated at the discharge end of the plant.

Other holding-down means can be used instead of the wheels 10 in FIGS. 4 and 5, and owing to their ability to hold down the material 9 and the conveyor belt 2 between the cam means 7', the wheels 10 may altogether replace the belt 5, particularly if the wheels 10 are provided with soft elastic surfaces, for instance foam rubber surfaces, which are capable of urging down the material 9 and the conveyor belt 2 between the cam means 7' and preferably are so wide as to urge the material 9 and the conveyor belt 2 into application with the backs or crests formed by the cam means 7. The arrangement of wheels in combination with the belt 5, which is shown in FIG. 4, is however preferred because the belt 5 simultaneously protects the material 9 against disturbances.

The illustrated arrangement of machine units 1 with triangular conveying paths and with the machine units arranged in a straight row can of course be modified subject to the available space. An obvious modification is to use, instead of a single straight row of machine units 1, several parallel rows including transverse transfer conveyors between the rows, in which case the treatment is carried out while the material is moved in one direction through one row of machine units and in the opposite direction through an adjoining row, etc. Of course, other arrangements are also possible.

As already mentioned, the machine units 1 preferably are of the same basic construction, it being understood that the individual machine units, possibly disregarding the first and last unit in the row or in each row, have similar frames with rolls, rollers or pulleys for the conveyor belts 2 mounted in the frame. The treating equipment proper, such as the means 5, 6, 7 and 10, however, may vary depending upon the type of treatment to be preformed in each operating step, such as stretching, graining and staking, pressing etc., i.e. per se known methods for processing leather and skin.

As already mentioned in the foregoing, the equipment for the conditioning, i.e. drying, usually hot air drying, and remoistening operations may also be designed with the use of various aids, such as nozzles 6 in the embodiment of FIG. 1. The elastic conveyor belt 2 and optionally also the belt 5 preferably are in the shape of an expansible fabric, which may for instance have a structure similar to that of a nylon stocking. As a result, blowing can be effected very efficiently also from the underside through the belt 2 proper and/or from the upper side through the belt 5. As already mentioned, the units 1 may be placed under hoods or in cabinets for greater effectiveness and for reduction of the costs for the drying and moistening operations, each machine unit 1 preferably having such a hood or such a cabinet with means facilitating assembly of the hoods or cabinets of adjoining machine units. If suitable conditioning rooms or enclosures are available already, these may naturally be utilized and extra costs avoided.

It will appear from FIG. 1 that in the simplest case the machine units 1 do not require any fixed connection with each other, i.e. they can simply be placed end to end provided that they are so arranged as to maintain their positions in relation to each other. If desired, however, the machine frames can readily be connected in a detachable manner with one another. This also applies to the conditioning hoods or cabinets, if such are used.

As already hinted at, machine units according to the invention can also be equipped with other kinds of treating means than those described, such as means for glazing, embossing, satining, graining, so-called dollying etc., whereby units can readily be assembled to processing plants for any desired series of conventional treating processes, but carried out under successive conveyance of the material from machine unit to machine unit in the plant.

What I claim and desire to secure by Letters Patent is:

1. A processing plant for treating workpieces consisting of hides, skins, pieces of leather or like materials, comprising: frame means supporting workpiece treating means and workpiece conveyor means including endless belt means, and guide means for said belt means, wherein said plant comprising an assemblage of a plurality of independent machine units arranged in a cooperative manner, each of which units comprises a frame, an endless belt conveyor having a workpiece receiving end and a workpiece delivering end, guide means for said belt conveyor and at least one workpiece treating means for effecting at least one of a plurality of treating operations, said units including the respective frames, belt conveyors and guide means being of fundamentally the same basic construction, the workpiece receiving end of the belt conveyor of each of said machine units, except the first one in the assemblage thereof, being arranged and positioned to receive workpieces transported to the delivering end of the belt conveyor of each preceding one of said units for moving said workpieces in a continuous path along the assemblage of machine units to be treated successively by their treating means, each of said units being capable of being driven in interaction with the other units at a different speed, said treating means supported by said frames of the machine units being selected and adapted to effect a series of treating operations including operations by which the length of each workpiece is changed, each of said units comprising driving means which are controlled to drive the respective conveyor belt at a speed such that said belt conveyors are adapted to transport said workpieces continuously along said path so that the individual speed of the conveyor of each succeeding unit compensates for any change in the length of workpieces in the preceding unit, the units being arranged and dimensioned so that each conveyor belt comprises an upwardly inclined workpiece transporting run and a downwardly inclined workpiece transporting run, and said belt conveyors of said machine units together form a continuous sinusoidal transporting path of a substantially greater length than the total horizontal length of said assemblage of machine units.

* * * * *